US006854143B2

(12) United States Patent
Sharples

(10) Patent No.: US 6,854,143 B2
(45) Date of Patent: Feb. 15, 2005

(54) PERMEABLE MATTRESS

(76) Inventor: Neville John Sharples, 25 Bligh Street, Sydney, New South Wales (AU)

( * ) Notice: Subject to any disclaimer, the term of this patent is extended or adjusted under 35 U.S.C. 154(b) by 0 days.

(21) Appl. No.: 10/182,860

(22) PCT Filed: Feb. 1, 2001

(86) PCT No.: PCT/AU01/00089

§ 371 (c)(1),
(2), (4) Date: Jul. 30, 2002

(87) PCT Pub. No.: WO01/56430

PCT Pub. Date: Aug. 9, 2001

(65) Prior Publication Data

US 2003/0000020 A1 Jan. 2, 2003

(30) Foreign Application Priority Data

Feb. 2, 2000 (AU) ..... PQ5389
Sep. 12, 2000 (AU) ..... PR0081

(51) Int. Cl.[7] ..... A47C 27/00; A47C 21/04
(52) U.S. Cl. ..... 5/724; 5/652.1
(58) Field of Search ..... 5/724, 725, 638, 5/652.1

(56) References Cited

U.S. PATENT DOCUMENTS 18,886 A * 12/1857 Tolman ..... 5/724
932,024 A * 8/1909 Kalas et al. ..... 5/716
4,989,284 A * 2/1991 Gamm ..... 5/653
5,870,785 A 2/1999 Hooren
6,055,690 A * 5/2000 Koenig ..... 5/724

FOREIGN PATENT DOCUMENTS

| | | |
|---|---|---|
| EP | 0 052 389 A1 | 5/1992 |
| EP | 0 553 772 A2 | 8/1993 |
| EP | 0 873 709 A2 | 10/1998 |
| GB | 2 284 348 A | 6/1995 |
| WO | WO 98/30131 | 7/1998 |

* cited by examiner

*Primary Examiner*—Sunil Singh
(74) *Attorney, Agent, or Firm*—Roberts, Abokhair & Mardula, LLC

(57) ABSTRACT

The present invention discloses a permeable mattress, or permeable pillow, which includes a base (1). Cushioning support (3) are attached to the top of the base in a distributed manner, to support a mesh (4) which supports a person, or person's head. Adjacent to the mesh there may be one or more layers of each, or any, of the following; permeable fabric, permeable foam, permeable fibres or perforated rubber. The mattress may be covered in a layer of permeable fabric (6). Any of the layers may be removably attached to the mattress assembly. In a further embodiment of the invention, beneath the base of the mattress, or integral with the base, there may be provided a spill tray that has a contoured structure, to guide fluids such that they flow under gravity into a collecting bowl.

46 Claims, 7 Drawing Sheets

PERMEABLE MATTRESS

TECHNICAL FIELD

The present invention relates to a new type of mattress, and in particular, to a mattress that is permeable to air and liquids whilst providing adequate support to a person using the mattress.

The present invention further relates to a new type of pillow, and in particular, to a pillow that is permeable to air and liquids.

BACKGROUND ART

One suggested cause of Sudden Infant Death Syndrome (SIDS) is asphyxiation when infants sleeping face down rebreathe the air they have exhaled into their bedding. This may be alleviated by providing a mattress that is permeable to air, allowing expelled air to flow away, and thus allowing the infant to breathe fresh air.

Conventional mattresses are not sufficiently permeable to air, and can act as insulators. In a hot climate this is undesirable as it makes it more difficult for a sleeping person to lose heat. Furthermore, the sleeping person may accumulate sweat. Hence, there exists a need to provide a mattress that is, inter alias permeable to air and liquids, allows air to transport away a quantity of heat, and does not accumulate as much sweat.

In a conventional mattress liquids will soak into the mattress, effectively ruining the mattress. This is particularly problematic with infants who may spill drink, regurgitate or urinate on their bedding. A plastic sheet may be fitted, but this increases the risk of asphyxiation and makes the bed uncomfortable. Hence, there also exists a need to provide a mattress that is, inter alia, permeable to liquids and allows the liquids to flow away, where they may be collected below the mattress in a suitable container.

Household dust is a common trigger for allergies and asthma, reducing the levels of household dust in a bed can be expected to provide health benefits for those individuals affected by household dust. This applies particularly to infants, for whom allergies may not have been identified, and who spend long periods in bed.

Hence, there also exists a need to provide a mattress that is, inter alia, permeable to air and liquids whilst providing adequate support without excessive deflection, and which has lower levels of household dust than conventional mattresses.

For similar reasons as hereinbefore mentioned, there also exists a need to provide a pillow that is, inter alia, permeable to air and liquids, and which has lower levels of household dust than conventional pillows.

Existing patents describe mattresses, consisting of fabric stretched over a frame, that are permeable to air and liquids. A problem with this design is excessive deflection under load; this forces the person sleeping to the centre of the mattress. Furthermore, such a mattress may not offer appropriate support for the back, and standing on the mattress is difficult and dangerous.

Hence, there also exists a need to provide a mattress that provides, inter alia, adequate support throughout the surface of the mattress, and may be beneficial to older infants who move about and stand on the mattress, but are still at risk of asphyxiation.

Existing patents also describe mattresses consisting of a thick layer of permeable foam whereby the mattresses are permeable to air and liquids. However, thick layers of foam are generally not sufficiently permeable to prevent asphyxiation. Furthermore, weight placed on thick foam compresses the foam, which reduces the permeability of the foam.

Existing patents also describe mattresses designed to prevent asphyxiation by pumping air into a foam mattress. The present invention discloses, in part, a mattress which does not require such a pumping mechanism, and which seeks to improve reliability and ease of use, reduce cost, complexity and the risk of electric shock.

This identifies a need for an improved type of mattress, and/or pillow, which overcomes the problems inherent in the prior art.

DISLOSURE OF INVENTION

The present invention seeks to provide a mattress or pillow that is permeable to air and liquids, allows air to transport away a quantity of heat, and does not accumulate as much sweat as certain mattresses or pillows known today.

The present invention also seeks to provide a mattress that is permeable to liquids and allows the liquids to flow away, where they may be collected below the mattress in a suitable container.

The present invention also seeks to provide a mattress which is permeable to air and liquids whilst providing adequate support without excessive deflection, and which has lower levels of household dust than conventional mattresses.

The present invention further seeks to provide a pillow which is permeable to air and liquids, and which has lower levels of household dust than conventional pillows.

The present invention further seeks to provide a mattress which gives adequate support throughout the surface of the mattress, and may be beneficial to older infants who move about and stand on the mattress, but are still at risk of asphyxiation.

The present invention according to one aspect provides a permeable mattress that is permeable to air and liquids, the permeable mattress including:

- a base, the base being substantially rigid and incorporating cross members, the base including holes in the areas between the cross members to permit the flow of air and liquids through the base;
- cushioning supports attached to various cross members of the base, the cushioning supports being attached to and/or supported by the base in a distributed manner;
- a mesh which overlays all of the cushioning supports, the mesh being permeable to air and liquids, and the mesh being held in association with each of the cushioning supports by being attached to each cushioning support and/or by being attached to the base; and
- whereby, the permeable mattress provides adequate support to at least one person and the load of a person lying on the mattress is distributed over numerous cushioning supports, and, the mesh and cushioning support interfaces are structured such that air or liquids are not trapped at the interfaces.

According to another aspect of the present invention there is additionally provided a cover adjacent to the mesh, the cover including at least one layer selected from the following: permeable fabric, permeable foam, permeable fibres or perforated rubber, which can be used in combination if more than one layer is utilised. Further non-limiting broad forms of the present invention provide that: the permeable mattress is covered in a layer of permeable fabric; some or any of the layers may be removably attached to the permeable mattress; and beneath the base of the permeable mattress, or integral with the base, there is a spill tray which has a contoured structure to guide fluids such that they flow under gravity into a collecting bowl.

The present invention according to another embodiment provides a permeable mattress that is permeable to air and liquids, the permeable mattress including:

a flexible base, the flexible base being a substantially flexible frame or sheet and incorporating cross members;

rigid supports attached to various cross members of the flexible base, the rigid supports being attached to and/or supported by the flexible base in a distributed manner;

a mesh which overlays all of the rigid supports, the mesh being permeable to air and liquids, and the mesh being held in association with each of the rigid supports by being attached to each rigid support and/or by being attached to the flexible base; and whereby, the permeable mattress provides adequate support to at least one person and the load of a person lying on the mattress is distributed over numerous rigid supports, and, the mesh and rigid support interfaces are structured such that air or liquids are not trapped at the interfaces.

In other embodiments of the present invention: the permeable mattress is covered in at least one layer selected from the following: permeable fabric, permeable foam, permeable fibres or perforated rubber, which can be used in combination if more than one layer is utilised; some or any of the layers may be removably attached to the permeable mattress; a cushioning layer beneath the flexible base is provided; the cushioning layer is a separate mattress not integrated with the permeable mattress; and the mesh and cushioning support interfaces incorporate a gap between the mesh and a cushioning support, the gap provided by protrusions integrally formed as part of the mesh.

According to another aspect of an embodiment of the present invention the base is a rigid frame which includes bordering members, the bordering members able to associate with the periphery of components on the permeable mattress thereupon.

In still other embodiments: the mesh and the base have the same structure, so that the permeable mattress can be used either way up; the cushioning supports are made of soft rubber; the cushioning supports are made of foam rubber; the cushioning supports consist of springs; the cushioning supports are made of a single piece of soft rubber or of portions of soft rubber adhered together, different regions of the cushioning supports having varying cross-section, and/or different flexibility; and/or the cushioning supports are made of a single piece of foam rubber or of portions of foam rubber adhered together, different regions of the cushioning supports having varying cross-section, and/or different flexibility.

In yet still other embodiments: the mesh is a single piece of material that deforms appropriately under the load of a person whilst sleeping; the mesh consists of many small relatively rigid plates that can move vertically, independently of each other; the mesh is affixed to the cushioning supports or rigid supports by gluing; the mesh is attached to the base by ties, allowing the mesh to move downwards towards the base, but not permitting the mesh to move free of the cushioning supports or rigid supports; the mesh is manufactured such that where the mesh overlays the cushioning supports or rigid supports the mesh structure remains permeable to air and liquids; the mesh is manufactured such that where the mesh overlays the cushioning supports or rigid supports the mesh structure provides a sloping cap over the cushioning support or rigid support to allow liquid to flow down and away from the cushioning support or rigid support; the mesh is rounded at the edges; the mesh is made of thermoplastic elastomer; the mesh is made of an upper part and a lower part joined together; the upper part is made of a soft thermoplastic elastomer, and the lower part is a stronger and stiffer thermoplastic elastomer or polyethylene; the cover over the mesh is made of an open weave or knit of nylon; and/or the cover over the mesh is held in place and tensioned by passing it over the mesh and fixing it to the edges of the base.

In still further broad forms of the present invention the cover is attached to the mesh; any of the layers may be perforated; a top layer of the cover is provided and is made of foam; the top layer of the cover is made of foam rubber layers of different flexibilities adhered together, creating progressive stiffness or flexibility; the top layer of the cover is held in place and tensioned by passing the top layer of the cover over the mesh and fixing it to the edges of the base; the top layer of the cover is attached to the mesh; and/or the mattress has a permeable fabric cover.

In still yet other embodiments of the present invention, the permeable fabric cover consists of a top layer of the cover of soft permeable fabric stitched to a bottom layer of the cover of tough permeable fabric; the permeable fabric cover is moisture absorbing and can absorb sweat; the top layer of the cover is made of an open weave or knit of cotton, and the bottom layer of the cover is made of an open weave or knit of nylon; the permeable fabric cover is removably attached to the base; and/or the permeable fabric cover has buttonholes at the corners, and optionally along the sides, which attach to corresponding rounded hooks on the edges of the base or the mesh.

According to another aspect of the present invention there is provided a spill tray and collecting bowl beneath the base; the spill tray and the collecting bowl are made of rigid polyvinyl chloride; the spill tray has a raised lip around the edges and slopes down to the collecting bowl; and/or the permeable mattress is washable with water.

Still furthermore, in other embodiments of the present invention, the permeable mattress is a permeable pillow; the features of the permeable pillow are the same as those of the permeable mattress as hereinbefore claimed in any claim except for physical dimensions; and/or the layers may be removably attached to the pillow assembly, or wrapped around the pillow assembly as a cover. In another form of the invention there is provided a permeable mattress, substantially according to the embodiment described in the specification with reference to and as illustrated in the accompanying figures.

In another form of the invention there is provided a permeable pillow, substantially according to the embodiment described in the specification with reference to and as illustrated in the accompanying figures.

BRIEF DESCRIPTION OF FIGURES

The present invention will become better understood from the following detailed description of a preferred but non-limiting embodiment thereof, described in connection with the accompanying figures, wherein.

MODES FOR CARRYING OUT THE INVENTION

Figure 1:
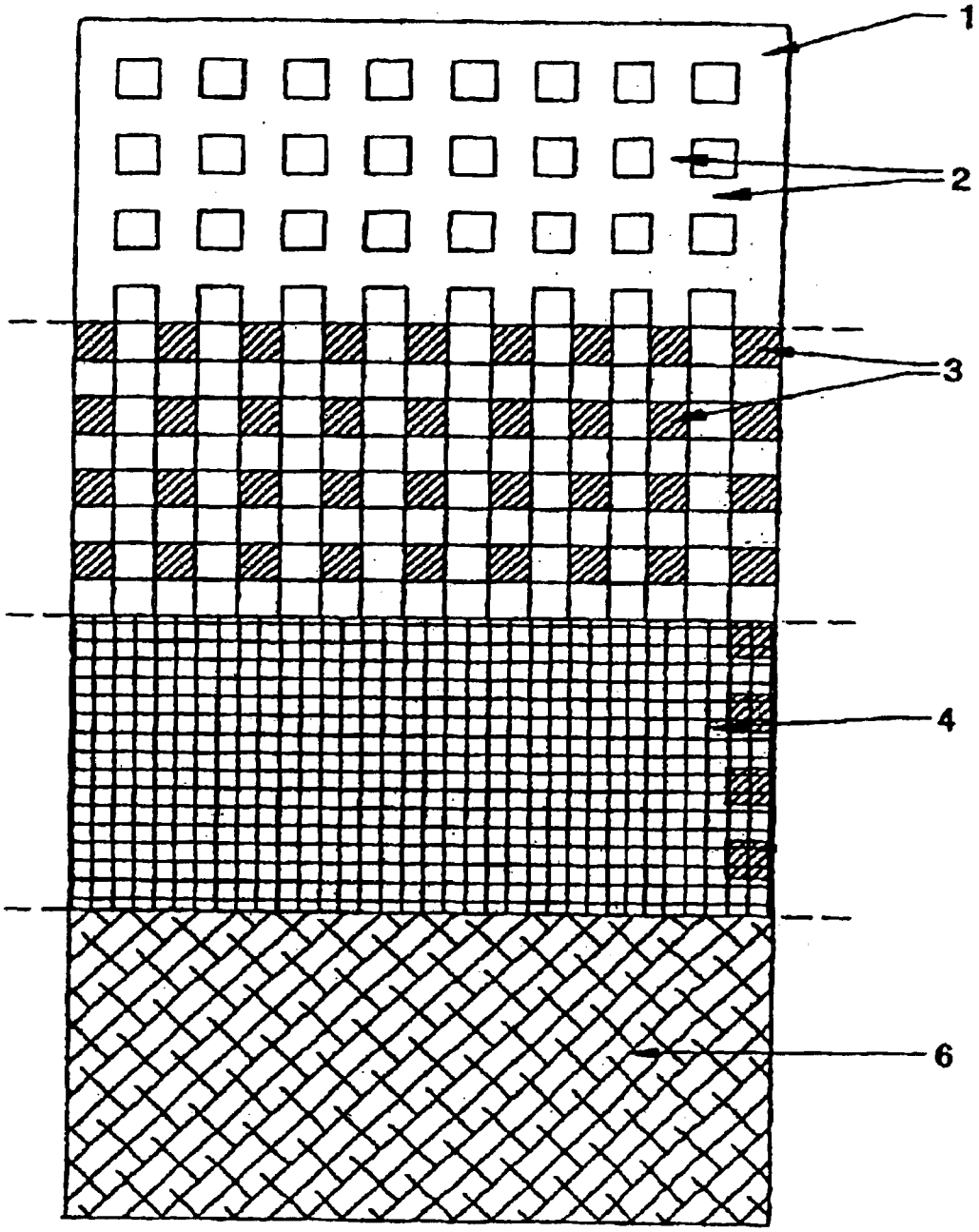
FIG. 1 illustrates a preferred embodiment of the present invention wherein, the figure shows a cross-sectional view of the mattress.
Figure 2:
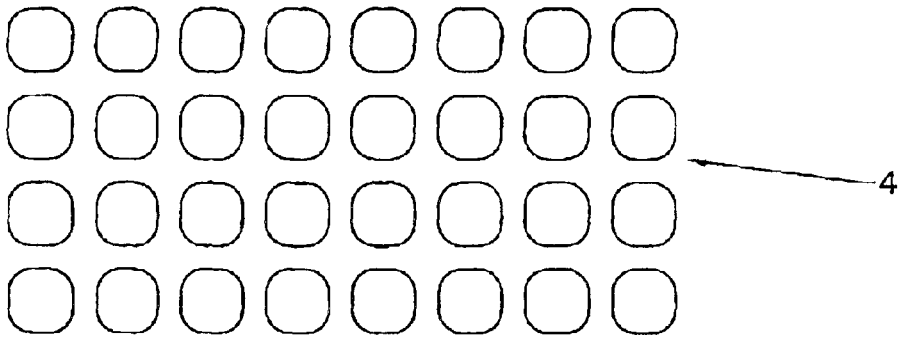
FIG. 2 illustrates a preferred embodiment of the present invention wherein, the figure shows a more detailed view of the upper part of the mesh.
Figure 3:
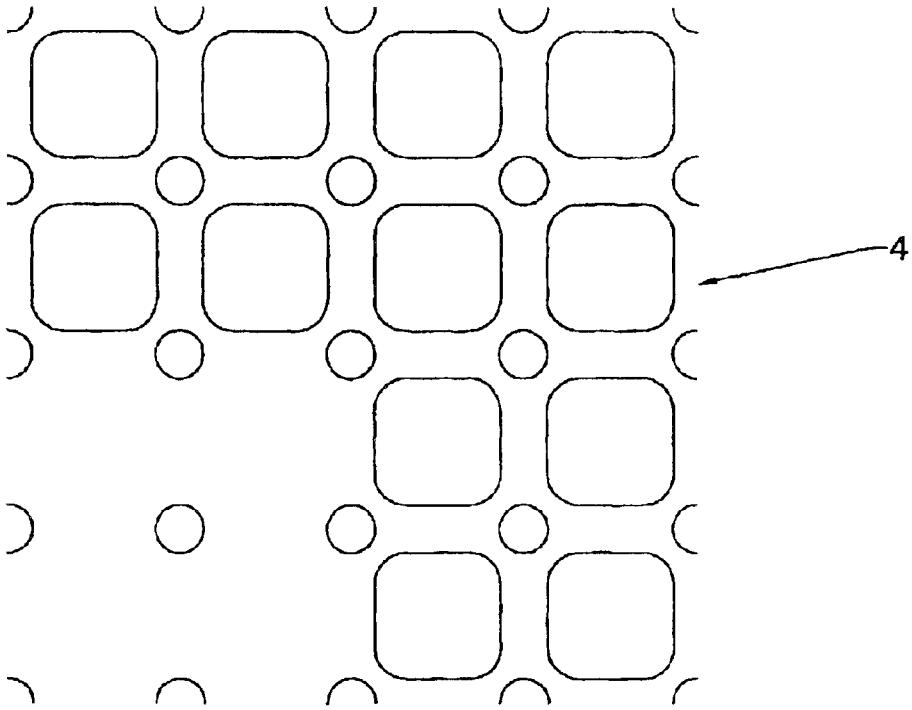
FIG. 3 illustrates a preferred embodiment of the present invention wherein, the figure shows a more detailed view of the lower part of the mesh.

The present invention provides an improved mattress or pillow. In the figures, incorporated to illustrate the features of the present invention, like reference numerals are used to identify like parts throughout the figures.

The present invention, in one particular embodiment, includes a base that is a rigid frame; cushioning supports are attached to the top of this frame to support a mesh which supports the person sleeping. Characteristics of this mesh are that it has some stiffness, it is not as flexible as fabric, and it provides support whilst allowing air and liquids to permeate the mesh. A finer mesh offers more even and more comfortable support.

In one form of the invention, the base is a rigid frame, which may be constructed of moulded plastic, painted wood or metal, such that it is resistant to various forms of damage, such as environmental damage, particularly from liquids which permeate from the top, and can be easily washed down.

A preferred, but non-limiting, embodiment of the permeable mattress is shown in FIG. 1. The frame (1) (base) consists of a border which marks the bottom of the general lateral extent of the mattress, together with cross members (2) which provide an attachment point for cushioning supports (3).

The cushioning supports (3) may be made of, for example, soft rubber, foam rubber or springs, although other materials having similar properties may be used. The combination of the stiffness of the cushioning supports (3) and the stiffness of the mesh (4) determines the softness of the mattress. A progressive rate of stiffness may be obtained by varying the cross-section of the materials used, or the layering of different materials. The cushioning supports (3) are attached to the frame (1) by, for example, gluing of rubber and foam rubber.

The mesh (4) is made of a material that is sufficiently rigid to maintain the structure of the mesh (4); that is the mesh (4) remains permeable and does not collapse. The mesh (4) should also be sufficiently rigid that it does not bend excessively between the cushioning supports (3). The mesh (4) may have some flexibility, so that it conforms approximately to the body shape of a person using the mattress, transferring the load to the cushioning supports (3).

Alternatively, a large number of small rigid plates, which can move vertically independently of each other can be used; each of the plates being attached to a cushioning support (3) at each vertex of the plate.

The mesh (4) must be attached so that it does not come away from the cushioning supports (3). It may be attached directly to the cushioning supports (3), for example by gluing; or may be attached to the frame (1), for example by ties.

Where the mesh (4) overlays the cushioning support (3), special attention must be given to the structure of the mesh. The mesh within this area must not block the flow of air or liquids, and optionally it may have a sloping cap over the cushioning support (3) that will conduct liquids away.

Figure 4:
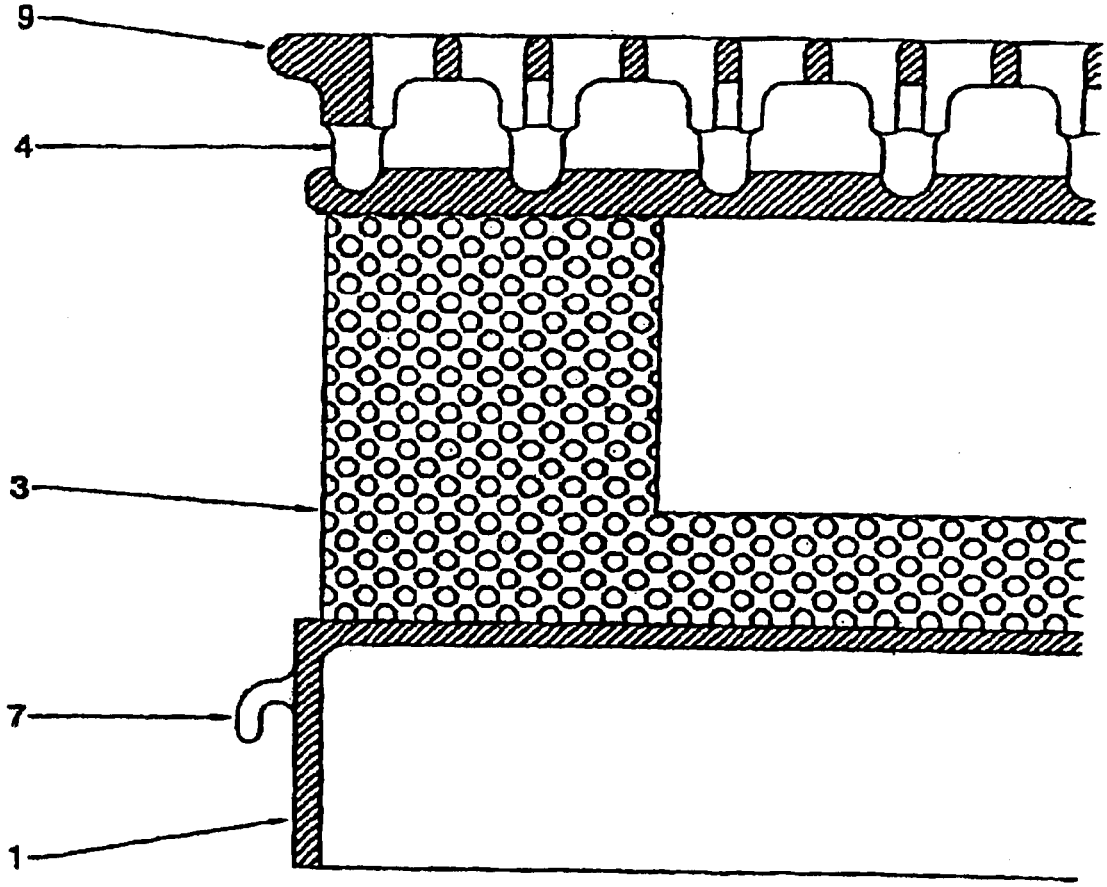
FIG. 4 illustrates a preferred embodiment of the present invention wherein, the figure shows a further detailed view of a section through the mattress.

At the edges of the mesh (9) some rounding is appropriate to ease wear on a fabric cover (6), as shown in FIG. 4. A suitable material to construct a single piece mesh, that provides a good compromise between rigidity and flexibility, and has adequate strength, is injection moulded thermoplastic elastomer, for example Santoprene®, to which a flame retardant may be added. A finer mesh offers more even and more comfortable support. Preferably, the mesh is made of an upper part and a lower part joined together, where the upper part is a made of soft thermoplastic elastomer, and the lower part is a stronger and stiffer thermoplastic elastomer or polyethylene.

Figure 6:
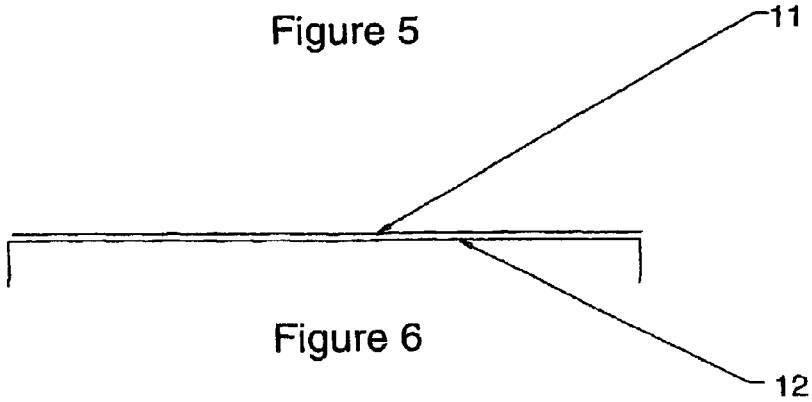
FIG. 6 illustrates a preferred embodiment of the present invention wherein, the figure shows a section through the top cover.

The fabric cover (6) may consist of two layers of fabric stitched together, as indicated in FIG. 6. Each layer must be permeable to air and liquids. Preferably the cover (6) can be washed in a washing machine. The top layer of the cover (11) provides a soft surface to the person sleeping. The top layer of the cover (11) is preferably moisture absorbing so that sweat does not build up where the body of the person sleeping overlays the material of the mesh (4). The bottom layer of the cover (12) provides strength to prevent a person's fingers being stuck between the interstices of the mesh (4). The bottom layer of the cover (12) also should give some support between the interstices of the mesh, and spaces the cover (6) from the mesh (4) thereby giving added permeability and reducing build up of moisture above the material of the mesh (4).

Figure 5:
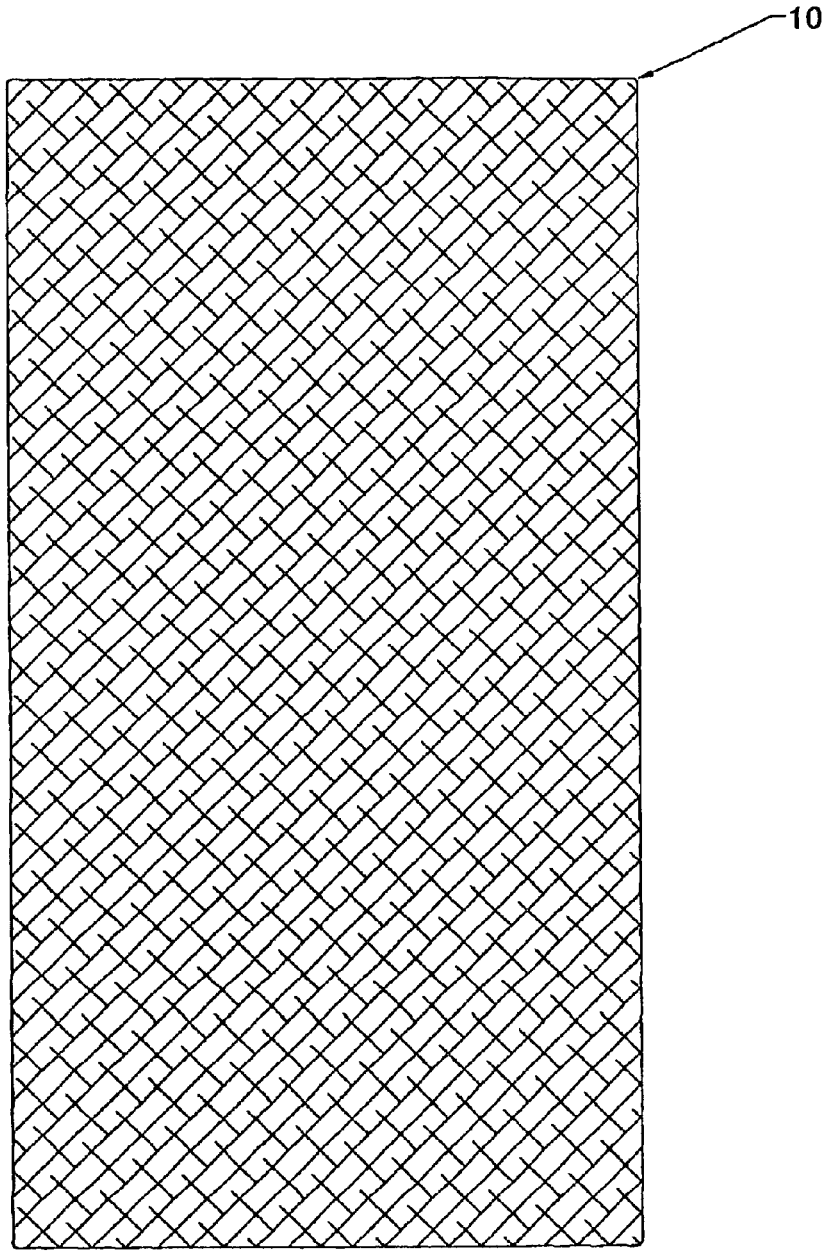
FIG. 5 illustrates a preferred embodiment of the present invention wherein, the figure shows a plan view of the top cover.

As indicated in FIG. 5, the cover (6) may be fitted to the mattress using buttonholes (10) at the corners of the cover (6) and optionally at selected points along the edges of the cover (6). These buttonholes (10) fasten to rounded hooks (7) moulded to the sides of the mattress, for example to the sides of the frame (1). This permits easy fitting and removal of the cover (6) and holds the cover (6) in place without interfering with the comfort of the person sleeping. Many other mechanisms to attach the cover (6) to the frame (1) can be envisaged, for example, ties, clips, velcro, pinning, stapling, etc. In an alternate embodiment of the present invention the cover (6) may be permanently attached to the frame (1).

Figure 7:
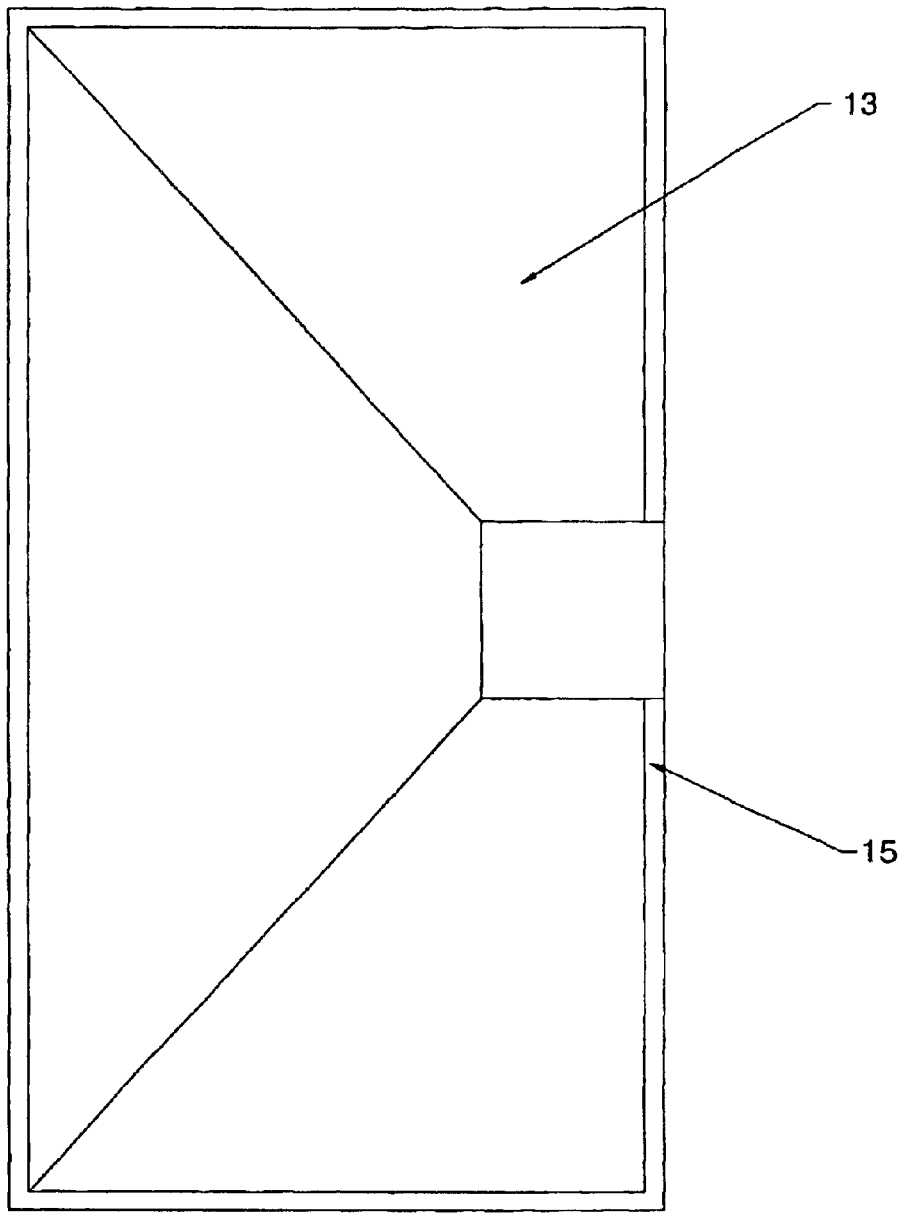
FIG. 7 illustrates a preferred embodiment of the present invention wherein, the figure shows a plan view of the spill tray and collecting bowl.
Figure 8:
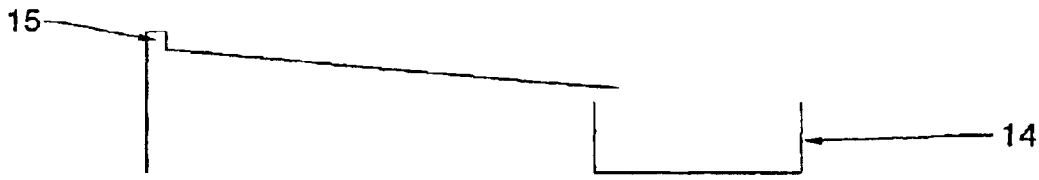
FIG. 8 illustrates a preferred embodiment of the present invention wherein, the figure shows a mid section through the spill tray and collecting bowl.

A spill tray (13), illustrated in FIG. 7 and FIG. 8, may be placed on the floor below the base of the mattress. The spill tray (13) slopes down from the edges to a collecting bowl (14), which is located at the centre of the front of the spill tray (13). A raised lip (15) runs around the edges of the spill tray (13) to stop liquids running off the edges of the spill tray (13). The spill tray (13) overlaps the edges of the collecting bowl (14), and the overlapping edges are turned down, so that liquid does not run back along the lower surface of the spill tray (13). A suitable material for the spill tray (13) and collecting bowl (14) is flame-resistant plastic, for example rigid polyvinyl chloride.

Figure 9:
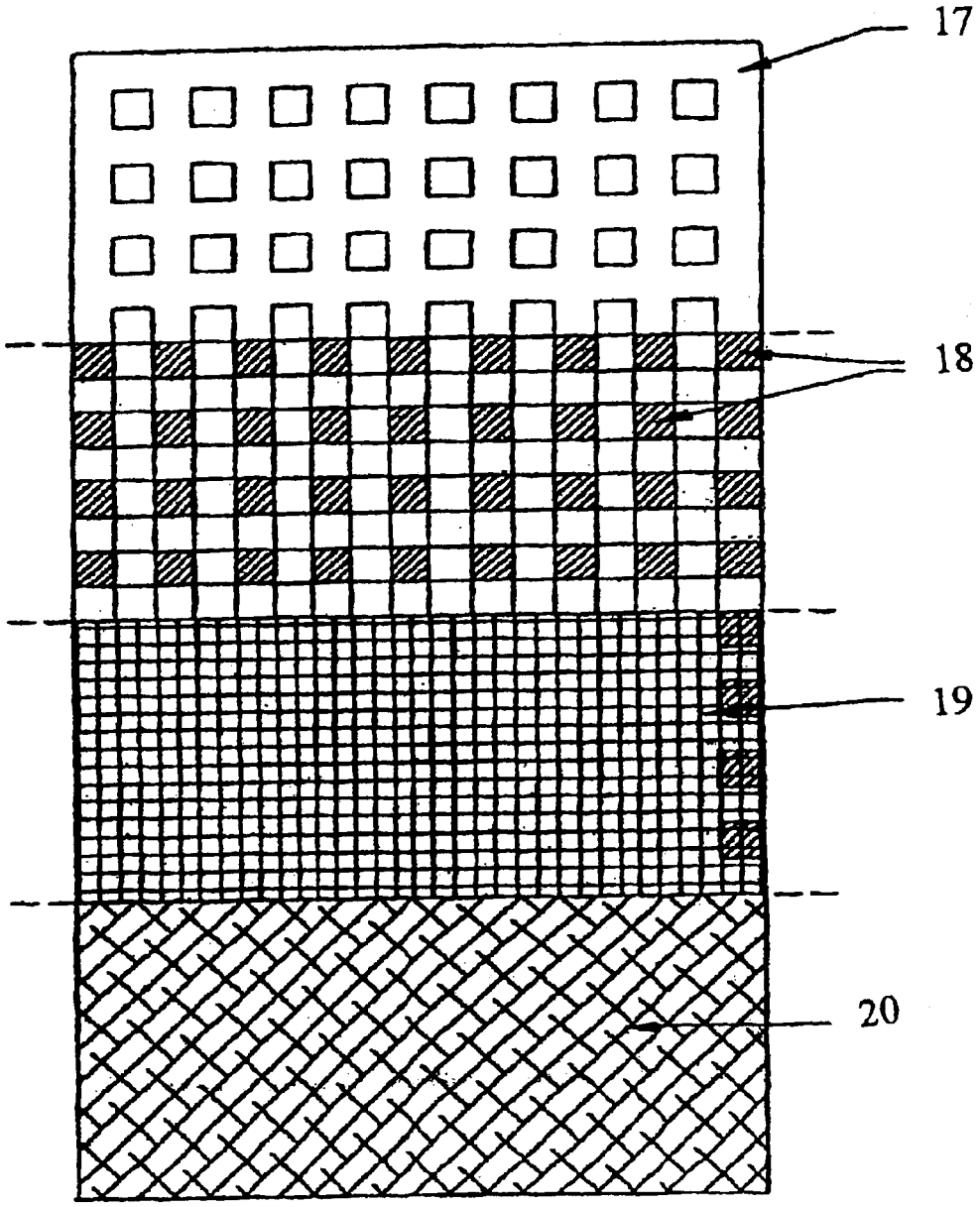
FIG. 9 illustrates an alternate embodiment of the present invention wherein, the figure shows a cross-sectional view of the mattress.
Figure 10:
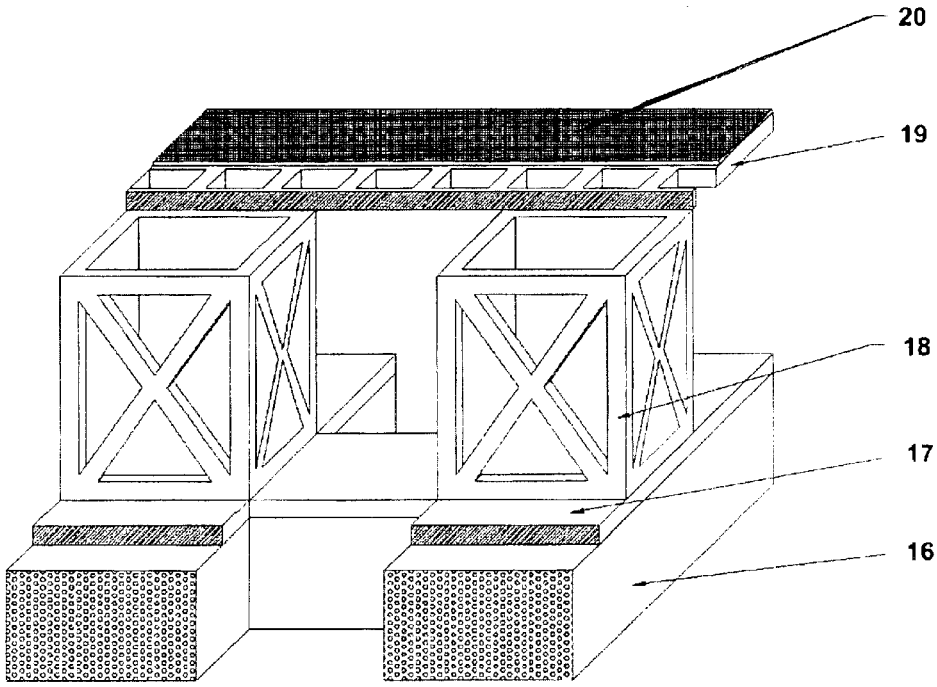
FIG. 10 illustrates an alternate embodiment of the present invention wherein, the figure shows a cross-sectional view of a portion of the mattress, with a cushioning layer.

In an alternate embodiment of the present invention, illustrated in FIG. 9 and 10, the frame (12) need not be rigid but may be flexible (ie. a flexible base). In this embodiment the cushioning supports (18) would be rigid supports. A cushioning layer (16) may be provided beneath the flexible base as additional support. The mesh (19) can be the same as previously described mesh (4). The cover (20) can be the same as previously described cover (6).

It should be noted that many different configurations of spill tray (13) may be used. Any geometry which guides liquid to some form of collecting bowl or area could be utilised and should be considered to fall within the scope of the present invention.

Although a mattress has been described in detail, the forgoing description can equally be applied to a pillow. Generally, only the dimensions of the preferred embodiment need be altered to construct a pillow. The spill tray (13) need not be utilised in the embodiment of the present invention as a pillow. Additional curvatures may be provided in, for example, the frame, inter alia, so that the pillow associates more readily with a person's head.

Thus, there has been provided in accordance with the present invention, a mattress and pillow which satisfies the advantages set forth above.

The invention may also be said broadly to consist in the parts, elements and features referred to or indicated in the specification of the application, individually or collectively, in any or all combinations of two or more of said parts, elements or features, and where specific integers are mentioned herein which have known equivalents in the art to which the invention relates, such known equivalents are deemed to be incorporated herein as if individually set forth.

Although the preferred embodiment has been described in detail, it should be understood that various changes, substitutions, and alterations can be made herein by one of ordinary skill in the art without departing from the spirit or scope of the present invention.

I claim:

1. A permeable mattress that is permeable to air and liquids, the permeable mattress including:

a substantially rigid base, the base incorporating substantially rigid cross members, the base including holes in the areas between the cross members to permit the flow of air and liquids through the base;

cushioning supports attached to various cross members of the base, the cushioning supports being attached to and supported by the base in a distributed manner;

a flexible mesh which overlays all of the cushioning supports, the mesh being permeable to air and liquids, the mesh being held in association with each of the cushioning supports by being attached to numerous cushioning supports, the top surface of the mesh also being held away from and above the base such that any point on the top surface of the mesh can move vertically independently of the base, and the mesh being composed of a material that does not absorb water; and whereby, the permeable mattress provides adequate support to at least one person and the load of a person lying on the mattress is distributed over numerous cushioning supports, and, the mesh and cushioning support interfaces are structured such that air or liquids are riot trapped at the interfaces.

2. The permeable mattress as claimed in claim 1, wherein there is additionally provided a cover adjacent to the mesh, the cover including at least one layer selected from the following: permeable fabric, permeable foam, permeable fibres or perforated rubber, which can be used in combination if more than one layer is utilised.

3. The permeable mattress as claimed in claim 2, wherein some or any of the layers may be removably attached to the permeable mattress.

4. The permeable mattress as claimed in claim 2, wherein the cover over the mesh is made of an open weave or knit of nylon.

5. The permeable mattress as claimed in claim 2, wherein the cover over the mesh is held in place and tensioned by passing it over the mesh and fixing it to the edges of the base.

6. The permeable mattress as claimed in claim 2, wherein the cover is attached to the mesh.

7. The permeable mattress as claimed in claim 2, wherein the at least one layer of the cover is perforated.

8. The permeable mattress as claimed in claim 2, wherein a top layer of the cover is provided and is made of foam.

9. The permeable mattress as claimed in claim 8, wherein the top layer of the cover is made of foam rubber layers of different flexibilities adhered together, creating progressive stiffness or flexibility.

10. The permeable mattress as claimed in claim 8, wherein the top layer of the cover is held in place and tensioned by passing the top layer of the cover over the mesh and fixing it to the edges of the base.

11. The permeable mattress as claimed in claim 8, wherein the top layer of the cover is attached to the mesh.

12. The permeable mattress as claimed in claim 2, having a permeable fabric cover.

13. The permeable mattress as claimed in claim 12, wherein the permeable fabric cover consists of a top layer of the cover of soft permeable fabric stitched to a bottom layer of the cover of tough permeable fabric.

14. The permeable mattress as claimed in claim 12, wherein the permeable fabric cover is moisture absorbing and can absorb sweat.

15. The permeable mattress as claimed in claim 12, wherein the top layer of the cover is made of an open weave or knit of cotton, and the bottom layer of the cover is made of an open weave or knit of nylon.

16. The permeable mattress as claimed in claim 12, wherein the permeable fabric cover is removably attached to the base.

17. The permeable mattress as claimed in claim 12, wherein the permeable fabric cover has buttonholes at the corners, and optionally along the sides, which attach to corresponding rounded hooks on the edges of the base or the mesh.

18. The permeable mattress as claimed in claim 1, wherein the permeable mattress is covered in a layer of permeable fabric.

19. The permeable mattress as claimed in claim 1, wherein beneath the base of the permeable mattress, or integral with the base, there is a spill tray which has a contoured structure to guide fluids such that they flow under gravity into a collecting bowl.

20. The permeable mattress as claimed in claim 1, wherein the mesh and cushioning support interfaces incorporate a gap between the mesh and a cushioning support, the gap provided by protrusions integrally formed as part of the mesh.

21. The permeable mattress as claimed in claim 20, wherein the base is a rigid frame which includes bordering members, the bordering members able to associate with the periphery of components on the permeable mattress thereupon.

22. The permeable mattress as claimed in claim 1, wherein the mesh and the base have the same structure, so that the permeable mattress can be used either way up.

23. The permeable mattress as claimed in claim 1, wherein the cushioning supports are made of soft rubber.

24. The permeable mattress as claimed in claim 1, wherein the cushioning supports are made of foam rubber.

25. The permeable mattress as claimed in claim 1, wherein the cushioning supports consist of springs.

26. The permeable mattress as claimed in claim 1, wherein the cushioning supports are made of a single piece of soft rubber or of portions of soft rubber adhered together, different regions of the cushioning supports having varying cross-section, or different flexibility.

27. The permeable mattress as claimed in claim 1, wherein the cushioning supports are made of a single piece of foam rubber or of portions of foam rubber adhered together, different regions of the cushioning supports having varying cross-section, or different flexibility.

28. The permeable mattress as claimed in claim 1, wherein the mesh is a single piece of material that deforms appropriately under the load of a person whilst sleeping.

29. The permeable mattress as claimed in claim 1, wherein the mesh consists of many small relatively rigid plates that can move vertically, independently of each other.

30. The permeable mattress as claimed in claim 1, wherein the mesh is affixed to the cushioning supports by gluing.

31. The permeable mattress as claimed in claim 1, wherein the mesh is attached to the base by ties, allowing the mesh to move downwards towards the base, but not permitting the mesh to move free of the cushioning supports.

32. The permeable mattress as claimed in claim 1, wherein the mesh is manufactured such that where the mesh overlays the cushioning supports the mesh structure remains permeable to air and liquids.

33. The permeable mattress as claimed in claim 1, wherein the mesh is manufactured such that where the mesh overlays the cushioning supports the mesh structure provides a sloping cap over the cushioning support to allow liquid to flow down and away from the cushioning support.

34. The permeable mattress as claimed in claim 1, wherein the mesh is rounded at the edges.

35. The permeable mattress as claimed in claim 1, wherein the mesh is made of thermoplastic elastomer.

36. The permeable mattress as claimed in claim 1, wherein the mesh is made of an upper part and a lower part joined together.

37. The permeable mattress as claimed in claim 36, wherein the upper part is made of a soft thermoplastic elastomer, and the lower part is a stronger and stiffer thermoplastic elastomer or polyethylene.

38. The permeable mattress as claimed in claim 1, wherein there is provided a spill tray and collecting bowl beneath the base.

39. The permeable mattress as claimed in claim 38, wherein the spill tray and the collecting bowl are made of rigid polyvinyl chloride.

40. The permeable mattress as claimed in claim 38, wherein the spill tray has a raised lip around the edges and slopes down to the collecting bowl.

41. The permeable mattress as claimed in claim 1, wherein the permeable mattress is washable with water.

42. The permeable mattress as claimed in claim 1, wherein the permeable mattress is a permeable pillow.

43. The permeable pillow as claimed in claim 42, wherein the layers may be removably attached to the pillow, assembly, or wrapped around the pillow assembly as a cover.

44. A permeable mattress that is permeable to air and liquids, the permeable mattress including:

a flexible base, the flexible base being a substantially flexible frame or sheet and incorporating cross members, the flexible base including holes in the areas between the cross members to permit the flow of air and liquids through the base;

rigid supports attached to various cross members of the flexible base, the rigid supports being attached to and supported by the flexible base in a distributed manner;

a flexible mesh which overlays all of the rigid supports, the mesh being permeable to air and liquids, and the mesh being held in association with numerous rigid supports, the top surface of the mesh also being held away from and above the flexible base such that any point on the top surface of the mesh can move vertically independently of the general extent of the top surface of the mesh, and the mesh being composed of a material that does not absorb water; and whereby, the permeable mattress provides adequate support to at least one person and the load of a person lying on the mattress is distributed over numerous rigid supports, and, the mesh and rigid support interfaces are structured such that air or liquids are not trapped at the interfaces.

45. The permeable mattress as claimed in claim 44, wherein the permeable mattress is covered in at least one layer selected from the following: permeable fabric, permeable foam, permeable fibres or perforated rubber, which can be used in combination if more than one layer is utilised.

46. The permeable mattress as claimed in claim 45, wherein some or any of the layers may be removably attached to the permeable mattress.

* * * * *